US009051763B2

(12) United States Patent
Taylor et al.

(10) Patent No.: US 9,051,763 B2
(45) Date of Patent: Jun. 9, 2015

(54) MULTI-POINT LOCK HAVING A SHOOTBOLT WITH A DRIVERAIL MOUNTED IN A U-SHAPED CHANNEL

(75) Inventors: Matt Taylor, Milton, WI (US); Scott Trogner, Fort Atkinson, WI (US); Dan Mattrisch, Fort Atkinson, WI (US)

(73) Assignee: HOPPE HOLDING AG, Mustair (CH)

( * ) Notice: Subject to any disclaimer, the term of this patent is extended or adjusted under 35 U.S.C. 154(b) by 111 days.

(21) Appl. No.: 13/219,196

(22) Filed: Aug. 26, 2011

(65) Prior Publication Data

US 2012/0049541 A1 Mar. 1, 2012

Related U.S. Application Data

(60) Provisional application No. 61/378,291, filed on Aug. 30, 2010.

(51) Int. Cl.

| | |
|---|---|
| ***E05C 1/02*** | (2006.01) |
| ***E05C 9/18*** | (2006.01) |
| ***E05C 9/20*** | (2006.01) |
| ***E05C 9/22*** | (2006.01) |
| *E05C 1/12* | (2006.01) |
| *E05C 9/10* | (2006.01) |
| *E05C 1/08* | (2006.01) |
| *E05C 1/06* | (2006.01) |
| *E05C 1/04* | (2006.01) |

(52) U.S. Cl.

CPC ..... *E05C 9/185* (2013.01); *Y10T 29/49826* (2015.01); *E05C 9/20* (2013.01); *E05C 9/22* (2013.01)

(58) Field of Classification Search

USPC ..... 292/2, 3, 5, 6, 7, 32, 33, 35, 36, 40, 41, 292/42, 63, 64, 66, 137, 165, 166, 16, 8, 292/174, 143, 145, 146, 147, 150, DIG. 15, 292/DIG. 44, DIG. 51, DIG. 53

See application file for complete search history.

(56) References Cited

U.S. PATENT DOCUMENTS

| | | | | | |
|---|---|---|---|---|---|
| 2,069,883 | A | * | 2/1937 | Hennicke | 70/114 |
| 3,378,290 | A | * | 4/1968 | Sekulich | 292/40 |
| 3,617,080 | A | * | 11/1971 | Miller | 292/38 |
| 3,649,060 | A | * | 3/1972 | Ruff | 292/42 |
| 4,643,005 | A | * | 2/1987 | Logas | 70/95 |
| 4,728,131 | A | * | 3/1988 | Burns | 292/7 |
| 4,896,905 | A | * | 1/1990 | Lehr et al. | 292/5 |
| 5,058,938 | A | * | 10/1991 | Doring et al. | 292/45 |
| 5,171,047 | A | * | 12/1992 | Korb et al. | 292/39 |

(Continued)

FOREIGN PATENT DOCUMENTS

EP 141891 A1 * 5/1985

*Primary Examiner* — Kristina Fulton
*Assistant Examiner* — Faria Ahmad
(74) *Attorney, Agent, or Firm* — Reinhart Boerner Van Deuren s.c.

(57) ABSTRACT

A multi-point lock having an easy to install modular drive mechanism for bolts located at the top and bottom edges of a door in which the multi-point locking system is installed that requires only relatively simple door preparation. The bolt operating mechanism is installed into a rectangular groove cut into a lateral edge of a door which may be cut using relatively simple tools in relatively quick fashion. The bolt actuating mechanisms consist of U-shaped channels each having a driverail slidably mounted therein, with the U-shaped channels fitting entirely within the groove into the lateral edge of the door above and below the mortise pocket.

19 Claims, 6 Drawing Sheets

(56) References Cited

U.S. PATENT DOCUMENTS

| | | | | |
|---|---|---|---|---|
| 5,350,207 | A * | 9/1994 | Sanders | 292/335 |
| 5,373,716 | A * | 12/1994 | MacNeil et al. | 70/109 |
| 5,542,720 | A * | 8/1996 | Fleming | 292/32 |
| 5,782,114 | A | 7/1998 | Zeus et al. | |
| 5,878,606 | A * | 3/1999 | Chaput et al. | 70/108 |
| 5,906,403 | A * | 5/1999 | Bestler et al. | 292/26 |
| 6,209,364 | B1 * | 4/2001 | Collet et al. | 70/107 |
| 6,209,931 | B1 | 4/2001 | Von Stoutenborough et al. | |
| 6,457,751 | B1 * | 10/2002 | Hartman | 292/137 |
| 6,883,837 | B1 * | 4/2005 | Lin | 292/33 |
| 6,905,152 | B1 * | 6/2005 | Hudson | 292/143 |
| 6,971,686 | B2 * | 12/2005 | Becken | 292/39 |
| 7,000,959 | B2 * | 2/2006 | Sanders | 292/340 |
| 7,404,306 | B2 * | 7/2008 | Walls et al. | 70/107 |
| 7,513,539 | B2 * | 4/2009 | Phipps | 292/36 |
| 7,543,860 | B2 * | 6/2009 | Meeks et al. | 292/137 |
| 7,707,862 | B2 * | 5/2010 | Walls et al. | 70/107 |
| 7,735,882 | B2 * | 6/2010 | Abdollahzadeh et al. | 292/44 |
| 8,099,907 | B2 * | 1/2012 | Balbo Di Vinadio | 49/506 |
| 8,157,299 | B2 * | 4/2012 | Mitchell et al. | 292/32 |
| 8,191,937 | B2 * | 6/2012 | Lin | 292/58 |
| 2008/0150300 | A1 * | 6/2008 | Harger et al. | 292/32 |
| 2012/0248789 | A1 * | 10/2012 | Mattrisch | 292/33 |

* cited by examiner

MULTI-POINT LOCK HAVING A SHOOTBOLT WITH A DRIVERAIL MOUNTED IN A U-SHAPED CHANNEL

IDENTIFICATION OF RELATED APPLICATIONS

This patent application is a non-provisional application and claims priority to U.S. Provisional Patent Application No. 61/378,291, filed on Aug. 30, 2010, which is hereby incorporated herein by reference in its entirety.

BACKGROUND OF THE INVENTION

FIELD OF THE INVENTION

The present invention relates generally to multi-point locking systems, and more particularly to a multi-point lock having an easy to install modular drive mechanism for shootbolts located at one of the top, bottom, lateral edges of a door in which the multi-point locking system is installed that requires only relatively simple door preparation.

Simple locks have a mortise unit mounted adjacent the edge of a door with a latch and, optionally, a deadbolt that extend from the mortise unit into a latch plate mounted in the door frame into which the door is installed. An increased level of security is afforded by multi-point door locks to provide more secure closure and locking. Typical conventional multi-point door locks have more than one latch or bolt that engages the door frame or adjacent panel, for example a French door. Multiple bolts are substantially more difficult to overcome in a forcible entry than a single deadbolt and latch, and facilitates enhanced weather sealing.

For example, instead of the conventional single latch and deadbolt extending from the mortise unit, three bolts and a latch may be used. A first deadbolt and latch engage with the door frame (or with a second door) that is locked into the closed position. A second bolt and a third bolt are respectively mounted at the top and bottom edges of the door above and below the mortise unit respectively to engage the upper and lower portions of the door frame, respectively. The second and third bolts, referred to as bolts, for example, shootbolts, tonguebolt, roundbolt, rollerbolt, swingbolt, and hookbolt, are also controlled by the mortise unit, and operate simultaneously with the deadbolt extending from the mortise unit. Examples of such multi-point locks may be found, for example, in U.S. Pat. No. 5,782,114, to Zeus et al., and in U.S. Pat. No. 6,209,931, to Von Stoutenborough at al., both of which are hereby incorporated herein.

Existing multipoint locks require extensive and complex preparation of the door to install the shootbolts of a conventional multi-point lock, including, for example, the installation of a square hole from the top to the bottom of the door to allow the installation of the shootbolts at the top and bottom edges of the door. Further, once installed, such conventional multi-point locks typically require the removal of the door in order to remove the lock from the door. It will be appreciated that such conventional multi-point locks are complex and expensive to install into a door, and that fairly complex and precise equipment is required in order to install such conventional multi-point locks into a door.

It is accordingly the primary objective of the present disclosure that it provide an easy installation of a multi-point lock into a door, not requiring a complex installation process. It is a related objective that the multi-point lock of the present disclosure be installable in a door using only relative simple tools to prepare the door for installation of the bolt and its bolt actuating mechanism. It is another objective of the multi-point lock of the present disclosure that the bolt and its bolt actuating mechanism be of relatively simple mechanical construction to further facilitate their installation into a door.

It is yet another objective of the present disclosure that the multi-point lock and/or the mortise unit be removable from a door without requiring the door to be removed. It is a related objective of the present disclosure that the multi-point lock of the present disclosure be of modular construction to facilitate both the installation as well as the removal of the multi-point lock of the present device. It is a further objective of the multi-point lock of the present disclosure that it be adaptable to fit doors of any size, preferably in a single kit which accommodates doors of different sizes.

The multi-point lock of the present disclosure must also be of construction which is both durable and long lasting, and it should also require little or no maintenance to be provided by the user throughout its operating lifetime. In order to enhance the market appeal of multi-point lock of the present disclosure, it should also be of inexpensive construction to thereby afford it the broadest possible market. Finally, it is also an objective that all of the aforesaid advantages and objectives be achieved by multi-point lock of the present disclosure without incurring any substantial relative disadvantage.

SUMMARY OF THE INVENTION

The disadvantages and limitations of the background art discussed above are overcome by the present disclosure. With this invention, the mortise lock, two bolt assemblies, and two bolt actuating mechanisms are provided which are of modular construction. The bolt operating mechanism is installed into a rectangular groove cut into a lateral edge of a door which may be cut using relatively simple tools, for example a router, in relatively quick fashion. A pocket for the mortise unit is cut into the lateral edge of the door as is conventional. Housings for the bolt assemblies are installed into cylindrical apertures drilled into the top and bottom edges of the door adjacent to and in communication with the groove cut in the lateral edge of the door.

The bolt actuating mechanisms consist of U-shaped channels each having a driverail slidably mounted therein, with the U-shaped channels fitting entirely within the groove cut into the lateral edge of the door above and below the mortise pocket. A distal end of each of the driverails is attached to a bolt by pushing the distal end of the driverail through a shootbolt housing, attaching the driverail to the bolt, and retracting the bolt into the shootbolt housing with the driverail. A proximal end of each of the driverails has an engagement mechanism located thereupon for engagement by the mortise unit.

The mortise unit has mating engagement mechanisms locate on the top and bottom sides thereof. As the mortise unit is slid into the mortise pocket in the door, the mating engagement mechanism on the top of the mortise unit will drivingly engage the proximal end of the driverail operating the bolt located in the top edge of the door, and the mating engagement mechanism on the bottom of the mortise unit will drivingly engage the proximal end of the driverail operating the bolt located in the bottom edge of the door. It will thus be appreciated that the mortise unit may be configured to open and close a deadbolt extending laterally from the mortise unit as well as the bolts located at the top and bottom of the door.

A thin cap or filler piece may be mounted on the lateral edge of the door to visually conceal the groove and the driverails. The housings for the shootbolt assemblies may have different mounting plates having different numbers of apertures for receiving mounting screws that are screwed onto the top or the bottom of the door. The shootbolts may be of either cylindrical or square configuration, as desired. The U-shaped channels of the shootbolt actuating mechanisms may optionally be mounted in the groove in the lateral edge of the door with mounting hardware such as screws. Alternately, the tops of the legs of the U-shaped channels may have barbed edges and the groove may have receiving deeper recesses along the sides thereof to receive the Barbed-edge legs of the U-shaped channels to retain the U-shaped channels in the groove once so installed.

There is further provided a multi-point lock including at least one shootbolt for mounting in one of a top and bottom edge of a door. At least one U-shaped channel is adapted for installation into a groove defined in a lateral edge of the door. At least one driverail, having proximal and distal opposite ends, is configured for installation into said U-shaped channel in a vertically slidable manner. The distal end of the driverail is engageable with the shootbolt to drive the shootbolt between a retracted position and an extended position. An engagement element is located in the driverail adjacent the proximal end of the driverail. There is also at least one bolt configured for mounting in the groove and pivotally coupled to the driverail, with the bolt configured to extend from and retract into the groove in unison with movement of the shootbolt. A mortise unit is configured for installation into the lateral edge of the door, with the mortise unit having a driving element associated with it that is moveable between an unlocked and locked position. The driving element engages the engagement element in the driverail when the mortise unit is installed into the lateral edge of the door after the U-shaped channel and the driverail have been installed into the groove. Wherein the shootbolt and the bolt are driven from their respective retracted position to an extended position when the driving element of the mortise unit is moved from said unlocked position to said locked position.

It may therefore be seen that the present disclosure teaches a multi-point lock having a shootbolt actuating mechanism that is easy to install in a door, and which does not require a complex installation process. The multi-point lock of the present disclosure has a bolt and a bolt actuating mechanism that are installable in a door using only relative simple tools to prepare the door for installation of the bolt and its bolt actuating mechanism. The bolt and its bolt actuating mechanism are of relatively simple mechanical construction to further facilitate their installation into a door.

The multi-point lock and/or the mortise unit of the present disclosure is removable from a door without requiring the door to be removed. It is of modular construction to facilitate both the installation as well as the removal of the multi-point lock of the present disclosure. The multi-point lock of the present disclosure is be adaptable to fit doors of any size, with a single kit accommodating doors of different sizes.

The multi-point lock of the present disclosure is of a construction which is both durable and long lasting, and which will require little or no maintenance to be provided by the user throughout its operating lifetime. The multi-point lock of the present disclosure is also of inexpensive construction to enhance its market appeal and to thereby afford it the broadest possible market. Finally, all of the aforesaid advantages and objectives are achieved by the multi-point lock of the present disclosure without incurring any substantial relative disadvantage.

DESCRIPTION OF THE DRAWINGS

These and other advantages of the present invention are best understood with reference to the drawings, in which.

DETAILED DESCRIPTION OF THE EXEMPLARY EMBODIMENT

The descriptions herein are directed to multi-point locks using bolts referred to as shootbolts extending from one of the top edge and bottom edge of a door, and more typically from both the top and bottom edges of the door. It should be understood that the term "bolt" as used herein in a multi-point lock is not an elongated fastener having a threaded portion and a head. As used herein, a "bolt" is a component of a multi-point lock that extends from a locking device installed in a top, bottom, and lateral edge of a door or window to engaged and secure the door or window to its frame or to another adjacent member, i.e. a French door unit.

It should also be understood that a bolt used in a multi-point lock may also be a shootbolt, tongue bolt, roundbolt, rollerbolt, swingbolt, and a hookbolt. Also, a multi-point lock can be configured to include bolts extending from a lateral edge of a door in addition to the top and bottom edge of the door, for example a 3 or 4 bolt multi-point lock.

The preferred embodiment of the multi-point lock of the present invention is shown in FIGS. 1 through 10, and includes five primary components: a mortise unit for installation into the lateral edge of a door, two shootbolt assemblies for installation into the top and bottom edges of the door adjacent to the lateral edge thereof, and two shootbolt actuating mechanisms for installation into a rectangular groove cut into the lateral edge of the door. The primary focus of the invention, however, is on the shootbolt actuating mechanisms and their installation into the groove cut into the lateral edge of the door.

Figure 1:
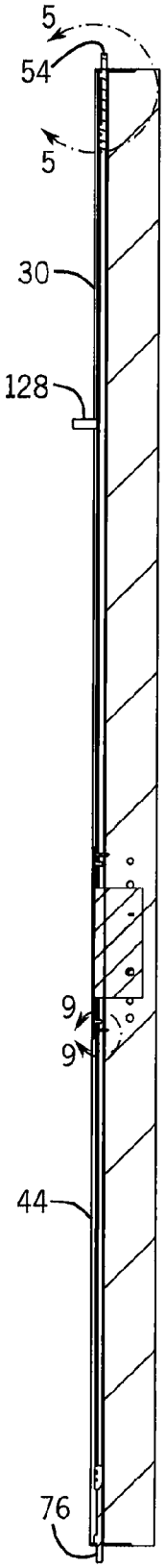
FIG. 1 is a somewhat schematic cross-sectional view of a portion of the closing edge of a door showing a dado into which the U-shaped channels and shootbolt actuating driverails of the present invention are installed respectively located at the top and bottom of the door.
Figure 2:
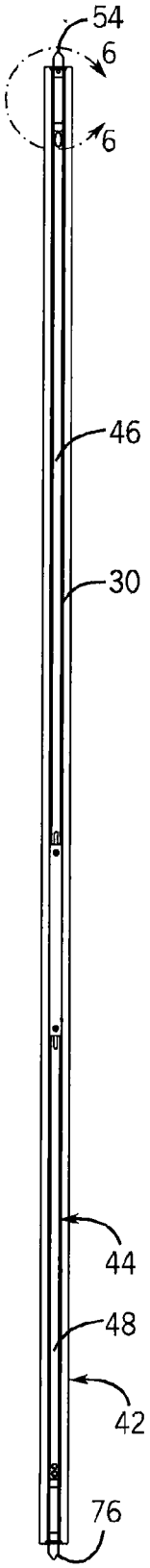
FIG. 2 is a side view of the U-shaped channels and shootbolt actuating driverails illustrated in FIG. 1 and the shootbolt assemblies to which they are respectively connected.
Figure 3:
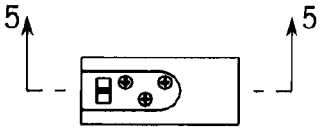
FIG. 3 is a top plan view of the top edge of the door illustrated on FIG. 1 showing one of the shootbolt assemblies which is mounted therein.
Figure 4:
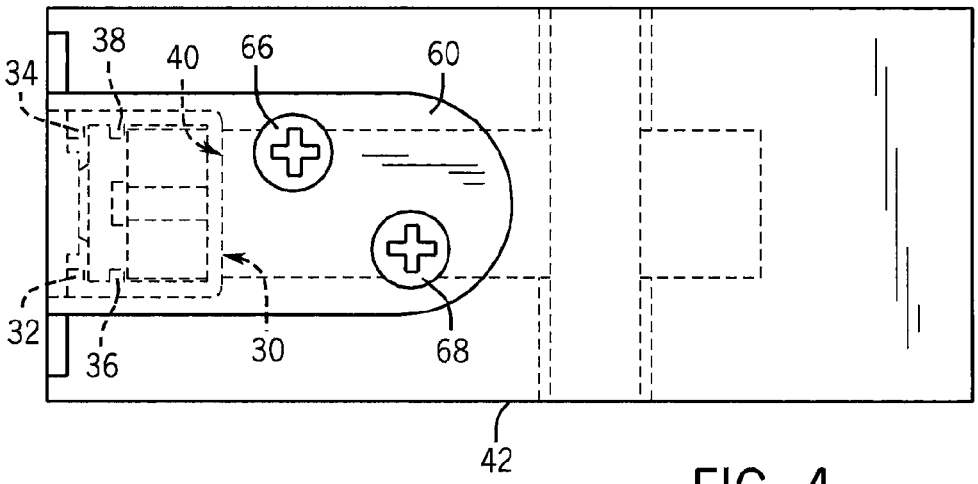
FIG. 4 is an enlarged top plan view of the shootbolt assembly illustrated in FIG. 3.
Figure 5:
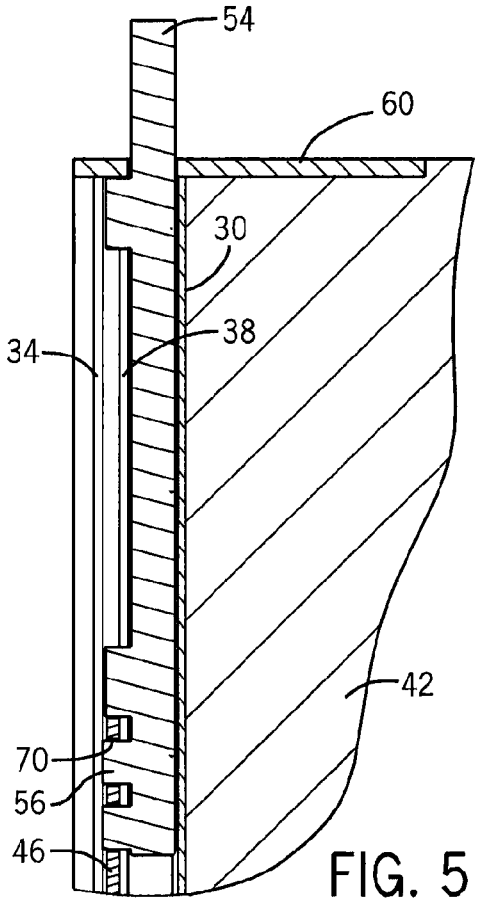
FIG. 5 is a cross-sectional view of the shootbolt assembly illustrated in FIGS. 3 and 4.
Figure 6:
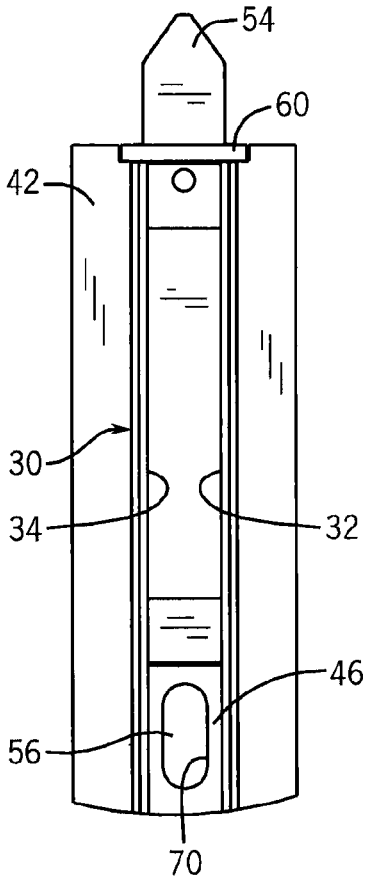
FIG. 6 is a lateral side view of the shootbolt assembly illustrated in FIGS. 3 through 5.
Figure 7:
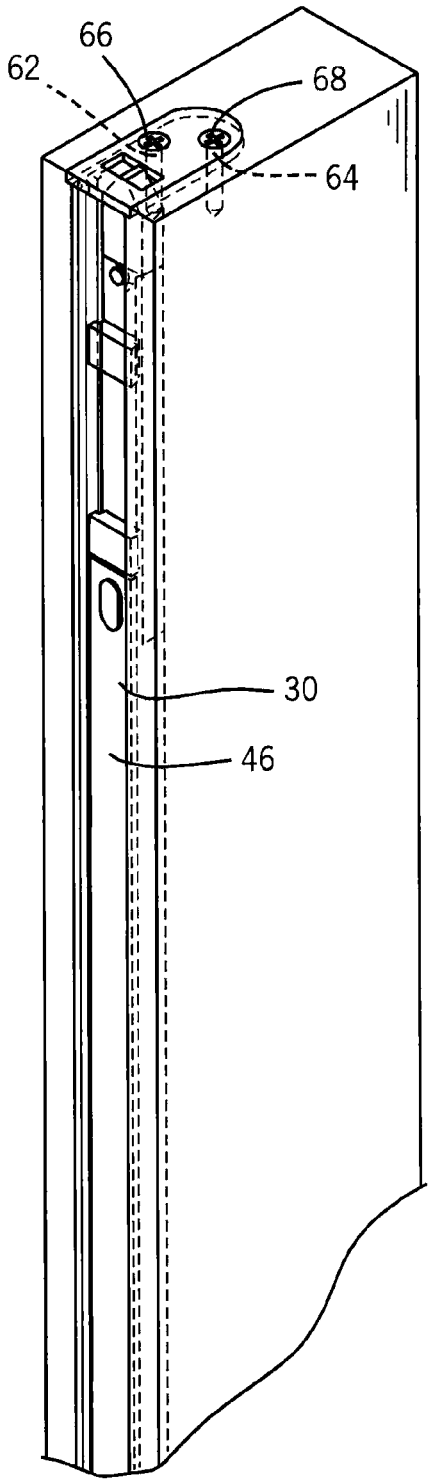
FIG. 7 is an isometric view of the shootbolt assembly illustrated in FIGS. 3 through 6 and the U-shaped channel and shootbolt actuating driverail attached thereto, with the door shown in phantom lines.
Figure 8:
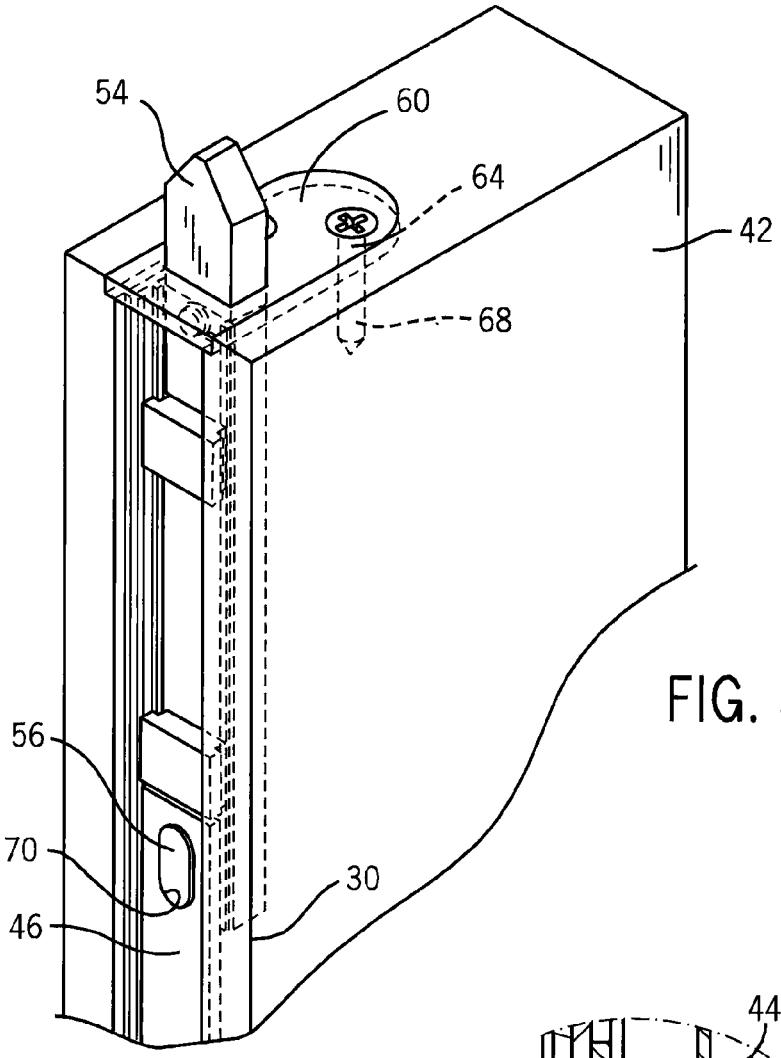
FIG. 8 is an isometric view of the shootbolt assembly illustrated in FIGS. 3 through 7, with the door shown in phantom lines.
Figure 9:
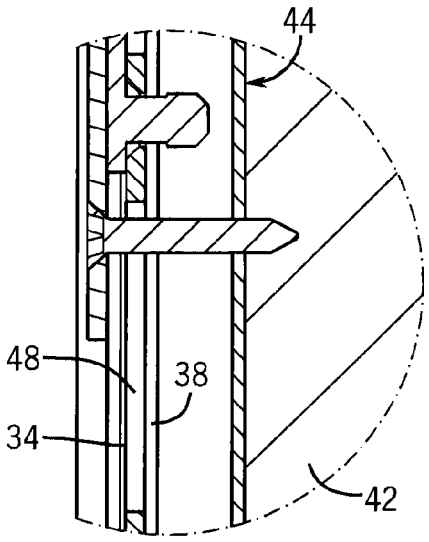
FIG. 9 is a cross-sectional view showing the interconnection between the mechanism used by the mortise unit to drive the shootbolt actuating driverails.
Figure 11:
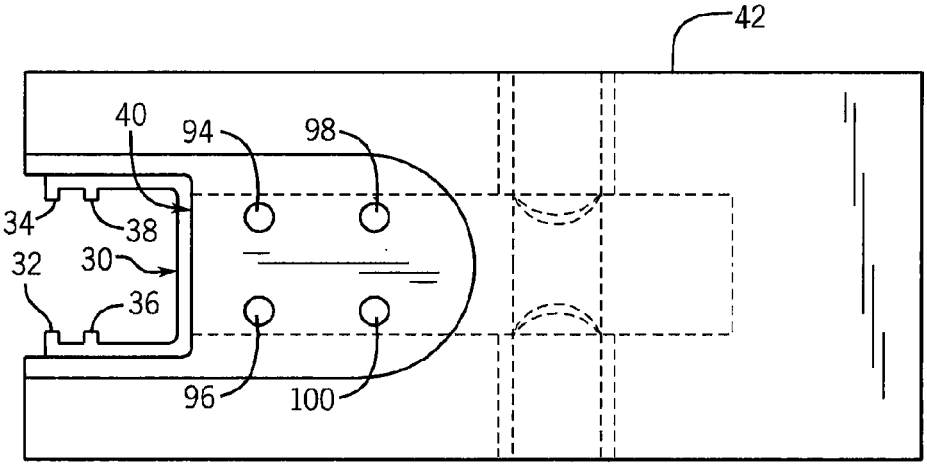
FIG. 11 is a top plan schematic view showing the alignment between the shootbolt assembly, the shootbolt actuating driverail, and the mortise unit.

The cross-sectional configuration of a U-shaped channel 30 is best shown in FIGS. 4 and 11 to be formed of a rectangular U-shape having a first opposed pair of inwardly-extending flanges 32 and 34 respectively located at the tops of the legs, and a second opposed pair of inwardly-extending flanges 36 and 38 respectively located on the legs of the U-shaped channel 30 spaced away from the first opposed pair of inwardly-extending flanges 32 and 34. The U-shaped channel 30 is located in a rectangular groove 40 cut into the lateral edge of the door 42 in the upper portion thereof. A second U-shaped channel 44 is located in the groove 40 in the lateral edge of the door 42 in the lower portion thereof.

A driverail 46 configured with a flat, rectangular cross-section is located in the U-shaped channel 30 intermediate the first opposed pair of inwardly-extending flanges 32 and 34 and the second opposed pair of inwardly-extending flanges 36 and 38. Similarly, a flat driverail 48 is located in the U-shaped channel 44 intermediate the opposed pairs of inwardly-extending flanges. The driverails 46 and 48 are slidably installed in the U-shaped channels 30 and 44, respectively. It should be understood that the cross-section shape of the drive rail 46, 48 may be other than rectangular, for example a driverail may have a circular cross-section.

A shootbolt 54 is slidably located in the portion of the U-shaped channel 30 intermediate the second opposed pair of inwardly-extending flanges 36 and 38 and the bottom of the "U." The shootbolt 54 has a pin 56 extending laterally therefrom into the area intermediate the first opposed pair of inwardly-extending flanges 32 and 34 and the second opposed pair of inwardly-extending flanges 36 and 38 where the driverail 46 is located.

The shootbolt 54 is retained in the U-shaped channel 30 by a mounting plate 60 located at the top thereof with a pair of apertures 62 and 64 located therein. The mounting plate 60 is installed onto the top edge of the door 42, and is retained in place with a pair of screws 66 and 68 which extend through the apertures 62 and 64 in the mounting plate 60, respectively, into the top edge of the door 42.

The driverail 46 has a mating aperture 70 located therein at its distal end thereof, which engages the pin 56 on the shootbolt 54. The distal end of the driverail 46 may be extended in the U-shaped channel 30 out of its top end, facilitating the shootbolt 54 being mounted onto the driverail 46 by inserting the pin 56 in the shootbolt 54 into the mating aperture 70 on the driverail 46. The driverail 46 may then retracted, pulling the shootbolt 54 into the interior of the U-shaped channel 30. In another embodiment the driverail 46 and shootbolt 54 are a single integral member, with a driverail portion and a shootbolt portion. A shootbolt 76 which is configured similarly to the shootbolt 54 and which extends from the U-shaped channel 44 is located in the bottom edge of the door 42, and the driverail 48 is configured similarly to the driverail 46 to facilitate mounting the distal end of the driverail 48 to the shootbolt 76.

Figure 10:
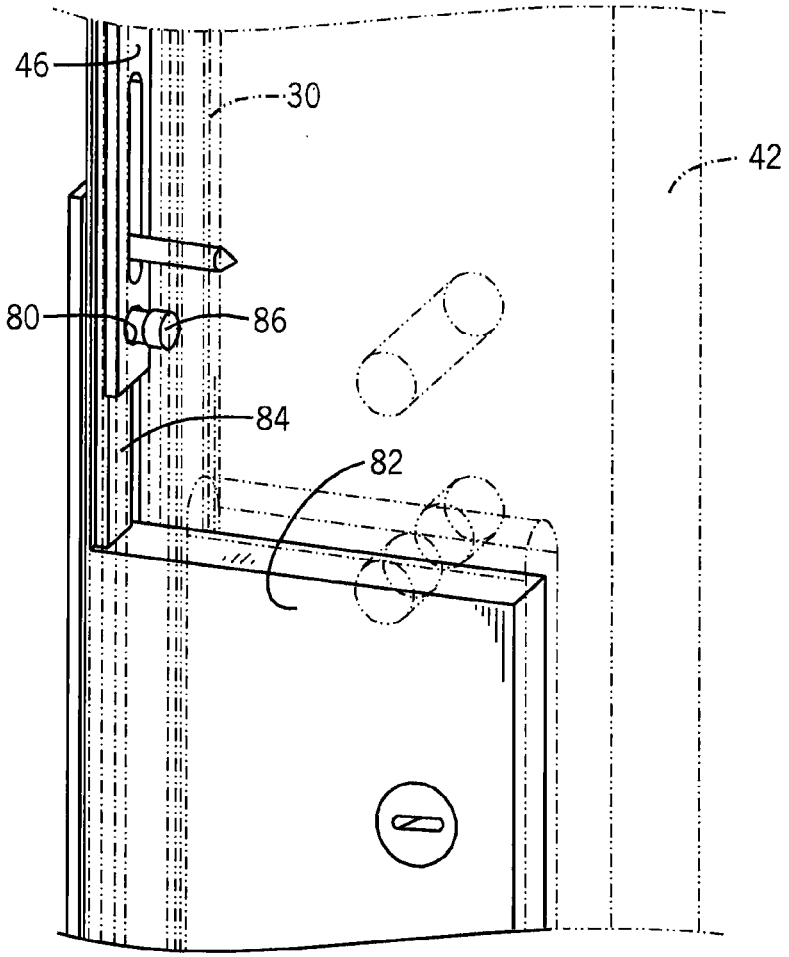
FIG. 10 is an isometric view of a portion of the door having the mortise unit mounted therein, showing the mechanism used by the mortise unit to drive the shootbolt actuating driverails, with the door shown in phantom lines.

The driverail 46 has an aperture 80 located near its proximal end thereof, as best shown in FIG. 10. A mortise unit 82 will be installed into the door 42 below the proximal end of the driverail 46. Extending from the top side of the mortise unit 82 is a reciprocally operable drive arm 84 which has an inwardly extending drive pin 86 located at the upper end thereof. When the mortise unit 82 is installed into the door 42 with the driverail 46 previously installed, the drive pin 86 of the mortise unit 82 will be inserted through the aperture 80 in the driverail 46. Thus, the mortise unit 82 will operate the driverail 46 to reciprocate the shootbolt 54.

Although it is not shown in the drawings, the driverail 48 is configured similarly to the driverail 46 with an aperture at its proximal end. The mortise unit 82 has a reciprocally operable drive arm extending from its bottom side which has an inwardly extending drive pin that engages the aperture of the driverail 48 to operate it simultaneously with the driverail 46. Thus, the shootbolt 76 is operated simultaneously with the shootbolt 54.

In an embodiment configured as a 3 or 4 bolt multi-point lock, a bolt 128 is pivotably coupled to the driverail 46. The bolt 128 is located in the lateral edge of the door or window between the mortise unit 82 and the shootbolt 54. When the shootbolt 54 is in the retracted position, the bolt 128 is also in a retracted position within the U-shaped channel 30. When the shootbolt 54 is moved to an extended position by the mortise unit 82, the bolt 128 is also moved to an extended position to engage a lateral portion of a door frame.

In a typical configuration, as the driverail 46 moves toward the shootbolt 54, the bolt 128 swings out of the U-shaped channel 30 about a pivot coupling to the driverail 46. Likewise as the driverail 46 moves away from the shootbolt 54 (but still coupled to the shootbolt 54), the bolt 128 swings back to the U-shaped channel 30 about the pivot coupling into the retracted position. It should be understood that a second bolt 128, in some configurations, is pivotably coupled to the driverail 48 similarly to the driverail 46 and is located between the mortise unit 82 and the shootbolt 76. In such embodiment, the two shootbolts 54, 76 and the two bolts 128 operate simultaneously with the mortise unit 82.

Referring next to FIG. 11, a mounting plate 92 is shown located at the top of the door 42 with four apertures 94, 96, 98, and 100 located therein. The mounting plate 92 is retained in place with four screws (not shown) which extend through the apertures 94, 96, 98, and 100 in the mounting plate 92 into the top edge of the door 42.

Figure 12:
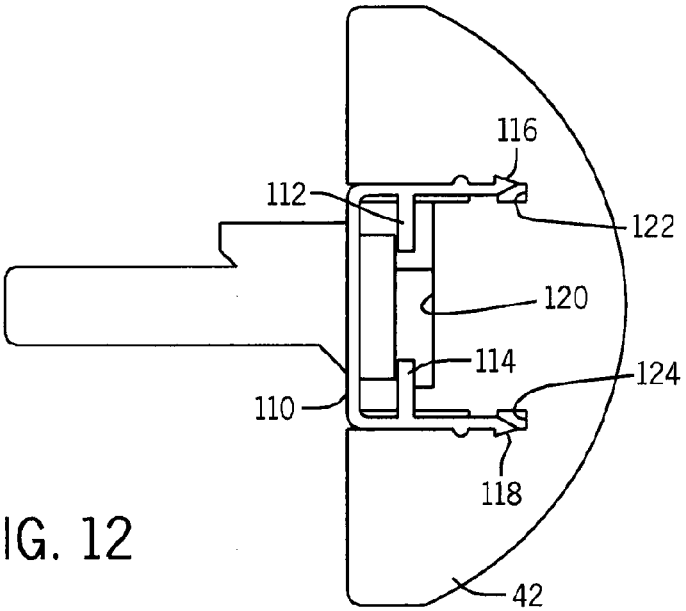
FIG. 12 is a top plan view of the top edge of a portion of the door with a self-installing U-shaped channel and shootbolt actuating driverail mounted therein.

Referring finally to FIG. 12, an alternate embodiment U-shaped channel 110 is illustrated which has a single pair of inwardly-extending flanges 112 and 114 respectively located on the legs of the U-shaped channel 110 spaced away from the bottom of the "U." The driverail 46 is slidably installed in the U-shaped channel 110 intermediate the pair of inwardly-extending flanges 112 and 114 and the bottom of the "U." The tops of the legs of the U-shaped channel 110 have barbed edges indicated generally by the reference numerals 116 and 118.

The U-shaped channel 110 is installed into a groove 120 having deeper recesses along the sides thereof as indicated generally by the reference numerals 122 and 124. The barbed edges 116 and 118 of the U-shaped channel 110 are pressed into the deeper recesses 122 and 124, respectively, to secure the U-shaped channel 110 in the groove 120.

It should be understood that the multi-point lock disclosed herein provide configurations used with a door composed of wood, hollow-frame structure, metal or composite engineered material. The groove 40 or 120 can be formed, for example, by molding, as the non-wooden door is fabricated.

The multi-point lock of the present disclosure accommodates a cap or filler for visually concealing the hardware, it allows for cost-effective transmission of mechanical force by minimizing fasteners needed to drive bolts, it simplifying door construction, it reduces the number of fasteners needed to install the multi-point lock, and it allows for substantial reinforcement of the door or window to the frame for better weather sealing.

Thus, it will be appreciated that the multi-point lock of the present disclosure may be used for manipulating the position of a side hinged door or window including French door/window applications. In general, the multi-point lock of the present disclosure finds application with two types of locks. The first is an "Active" mortise lock case featuring a latch, dead bolt, and primary and secondary inputs for operating the device, an upper and lower drive rail, an upper and lower shootbolt, an upper and lower shootbolt guide, and strike plates. The second is an "Inactive" mortise lock case featuring at least one input for operating the device, an upper and lower drive rail; an upper and lower shootbolt, an upper and lower shootbolt guide, and strike plates. User interfaces with a patio door handle may be set to operate the locks. The locks provide capability to engage shootbolts into the head and the sill and also to engage an Active mortise panel with an Inactive mortise panel. The locks provide capability to engage bolts that extend and retract from the lateral edge of a door in conjunction with bolts operative from the top and bottom of a door.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

It may therefore be appreciated from the above detailed description of the preferred embodiment of the present disclosure that it teaches a multi-point lock having a shootbolt actuating mechanism that is easy to install in a door, and which does not require a complex installation process. The multi-point lock of the present disclosure has a shootbolt and a shootbolt actuating mechanism that are installable in a door using only relative simple tools to prepare the door for installation of the shootbolt and its shootbolt actuating mechanism. The shootbolt and its shootbolt actuating mechanism are of relatively simple mechanical construction to further facilitate their installation into a door.

The multi-point lock and/or the mortise unit of the present disclosure is removable from a door without requiring the door to be removed. It is of modular construction to facilitate both the installation as well as the removal of the multi-point lock of the present disclosure. The multi-point lock of the present disclosure is adaptable to fit doors of any size, with a single kit accommodating doors of different sizes.

The multi-point lock of the present disclosure is of a construction which is both durable and long lasting, and which will require little or no maintenance to be provided by the user throughout its operating lifetime. The multi-point lock of the present disclosure is also of inexpensive construction to enhance its market appeal and to thereby afford it the broadest possible market. Finally, all of the aforesaid advantages and objectives are achieved by the multi-point lock of the present disclosure without incurring any substantial relative disadvantage.

Although the foregoing description of the present disclosure has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the multi-point lock as described herein may be made, none of which depart from the spirit or scope of the present disclosure. The particular embodiments and applications were chosen and described to provide the best illustration of the principles of the multi-point lock and its practical application to thereby enable one of ordinary skill in the art to utilize the multi-point lock in various embodiments and with various modifications as are suited to the particular use contemplated. All such changes, modifications, variations, and alterations should therefore be seen as being within the scope of the present disclosure as determined by the appended claims when interpreted in accordance with the breadth to which they are fairly, legally, and equitably entitled.

What is claimed is:

1. A multi-point lock comprising:

at least one shootbolt for mounting in one of a top and bottom edge of a door;

at least one U-shaped channel adapted for installation into a groove defined in a lateral edge of the door, wherein the groove extends the full length of the lateral edge of the door;

at least one driverail having proximal and distal opposite ends, said driverail being configured for installation into said U-shaped channel in a vertically slidable manner, said distal end of said driverail being engageable with said shootbolt to drive said shootbolt between a retracted position and an extended position;

an engagement element located in said driverail adjacent said proximal end thereof; and a mortise unit adapted for installation into the lateral edge of the door, said mortise unit having a driving element associated therewith that is moveable between unlocked and locked positions, said driving element engaging said engagement element in said driverail when said mortise unit is installed into the lateral edge of the door after said U-shaped channel and said driverail have been installed into said groove;

wherein said shootbolt is driven from said retracted position to said extended position when said driving element of said mortise unit is moved from said unlocked position to said locked position;

wherein the U-shaped channel includes first and second sidewalls and an end wall extending between the first and second sidewalls generally providing a closed end of the U-shaped channel, the first and second sidewalls being straight sidewalls extending from the end wall to an open end of the U-shaped channel, wherein the first and second sidewalls and end wall define a channel aperture, the first sidewall including a first flange extending into the channel aperture and a second flange extending into the channel aperture, the second flange being located between the first flange and the end wall, the second sidewall including a first flange extending into the channel aperture and a second flange extending into the channel aperture, the second flange being located between the first flange and the end wall, the first flanges and the second flanges defining a passage there between, the passage being configured to receive the at least one driverail therein.

2. The multi-point lock of claim 1, wherein the mortise is one of an active mortise and an inactive mortise.

3. The multi-point lock of claim 1, further comprising:

at least one additional shootbolt for mounting in one of a top and bottom edge of the door;

at least one additional U-shaped channel configured for installation into the groove defined in the lateral edge of the door;

at least one additional driverail having proximal and distal opposite ends, said additional driverail being configured for installation into said additional U-shaped channel in a vertically slidable manner, said distal end of said driverail being engageable with said additional shootbolt to drive said shootbolt between a retracted position and an extended position; and an additional engagement element located in said additional driverail adjacent said proximal end thereof;

wherein the mortise includes an additional driving element associated therewith that is moveable between unlocked and locked positions, said additional driving element engaging said additional engagement element in said additional driverail wherein both shootbolts are driven from said retracted position to said extended position when both driving elements of said mortise unit is moved from said unlocked position to said locked position.

4. The multi-point lock of claim 1, further comprising a cap configured to cover at least the width of the groove.

5. The multi-point lock of claim 4, wherein the cap is configured to engage one of the channel and the groove.

6. A multi-point lock comprising:

a first shootbolt for mounting in a top edge of a door;

a first U-shaped channel adapted for installation into a groove defined in a lateral edge of the door, wherein the groove extends the full length of the lateral edge of the door, the first U-shaped channel having an open end and a closed end and first and second straight legs extending from the open end to the closed end, wherein the first and second sidewalls and end wall define a channel aperture, the first sidewall including a first flange extending into the channel aperture and a second flange extending into the channel aperture, the second flange being located between the first flange and the end wall, the second sidewall including a first flange extending into the channel aperture and a second flange extending into the channel aperture, the second flange being located between the first flange and the end wall, the first flanges and the second flanges defining a passage there between, the passage being configured to receive the at least one driverail therein;

a first driverail having proximal and distal opposite ends, said first driverail being configured for installation into said first U-shaped channel in a vertically slidable manner, said distal end of said first driverail being engageable with said first shootbolt to drive said first shootbolt between a retracted position and an extended position;

a first engagement element located in said first driverail adjacent said proximal end thereof;

a second shootbolt for mounting in a bottom edge of a door;

a second U-shaped channel adapted for installation into the groove in the lateral edge of the door, the second U-shaped channel having an open end and a closed end and first and second straight legs extending from the open end to the closed end;

a second driverail having proximal and distal opposite ends, said second driverail being adapted for installation into said second U-shaped channel in a vertically slidable manner, said distal end of said second driverail being engageable with said second shootbolt to drive said second shootbolt between a retracted position and an extended position;

a second engagement element located in said second driverail adjacent said proximal end thereof; and a mortise unit adapted for installation into the lateral edge of the door, said mortise unit having first and second driving elements associated therewith that are moveable between unlocked and locked positions, said first driving element coupled to said first engagement element in said first driverail when said mortise unit is installed into the lateral edge of the door after said first U-shaped channel and said first driverail have been installed into said groove, said second driving element coupled to said second engagement element in said second driverail when said mortise unit is installed into the lateral edge of the door after said second U-shaped channel and said second driverail have been installed into said groove;

wherein said first and second shootbolts are driven from said retracted position to said extended position when said first and second driving elements of said mortise unit are moved from said unlocked position to said locked position.

7. The multi-point lock of claim 6, wherein the mortise is one of an active mortise and an inactive mortise.

8. The multi-point lock of claim 6, further comprising a cap configured to cover at least the width of the groove.

9. The multi-point lock of claim 8, wherein the cap is configured to engage one of each of the channels and the groove.

10. A method of installing a multi-point lock into a door, comprising:

mounting at least one shootbolt in one of a top and bottom edge of the door installing at least one U-shaped channel into a groove cut into a lateral edge of the door, wherein the groove extends the full length of the lateral edge of the door, the at least one U-shaped channel having an open side, a closed side, and a pair of straight sidewalls extending from the open side to the closed side, wherein the first and second sidewalls and end wall define a channel aperture, the first sidewall including a first flange extending into the channel aperture and a second flange extending into the channel aperture, the second flange being located between the first flange and the end wall, the second sidewall including a first flange extending into the channel aperture and a second flange extending into the channel aperture, the second flange being located between the first flange and the end wall, the first flanges and the second flanges defining a passage there between, the passage being configured to receive the at least one driverail therein;

providing at least one driverail having proximal and distal opposite ends in said U-shaped channel in a vertically slidable manner, said distal end of said driverail coupling with said shootbolt to drive said shootbolt between a retracted position and an extended position, said driverail having an engagement element located in said proximal end thereof;

installing a mortise unit into the lateral edge of the door after said U-shaped channel and said driverail have been installed into said groove, said mortise unit having a driving element associated therewith that is moveable between unlocked and locked positions, said driving element engaging said engagement element in said driverail; and driving said shootbolt from said retracted position to said extended position by moving said driving element of said mortise unit from said unlocked position to said locked position.

11. The method of installing a multi-point lock into a door of claim 10, wherein the mortise is one of an active mortise and an inactive mortise.

12. The method of installing a multi-point lock into a door of claim 10, further comprising providing a cap configured to cover at least the width of the groove.

13. The method of installing a multi-point lock into a door of claim 12, including installing the cap to engage one of the channel and the groove.

14. The method of installing a multi-point lock into a door of claim 10, further comprising:

mounting at least one additional shootbolt in one of a top and bottom edge of the door;

installing at least one additional U-shaped channel into the groove cut into the lateral edge of the door;

providing at least one additional driverail having proximal and distal opposite ends in said additional U-shaped channel in a vertically slidable manner, said distal end of said additional driverail coupling with said shootbolt to drive said shootbolt between a retracted position and an extended position, said driverail having an engagement element located in said proximal end thereof, wherein the mortise unit includes an additional driving element associated therewith that is moveable between unlocked and locked positions, said additional driving element engaging said additional engagement element in said additional driverail; and driving both shootbolts from said retracted position to said extended position by moving both driving elements of said mortise unit from said unlocked position to said locked position.

15. A multi-point lock comprising:

at least one shootbolt for mounting in one of a top and bottom edge of a door;

at least one U-shaped channel adapted for installation into a groove defined in a lateral edge of the door, wherein the groove extends the full length of the lateral edge of the door, the at least one U-shaped channel has an end wall closing a first side of the U-shaped channel, a first sidewall extending from the end wall to a second open side of the U-shaped channel, and a second sidewall extending parallel to the first sidewall from the end wall to the second open side of the U-shaped channel, wherein the first and second sidewalls and end wall define a channel aperture, the first sidewall including a first flange extending into the channel aperture and a second flange extending into the channel aperture, the second flange being located between the first flange and the end wall, the second sidewall including a first flange extending into the channel aperture and a second flange extending into the channel aperture, the second flange being located between the first flange and the end wall, the first flanges and the second flanges defining a passage there between, the passage being configured to receive the at least one driverail therein;

at least one driverail having proximal and distal opposite ends, said driverail being configured for installation into said U-shaped channel in a vertically slidable manner, said distal end of said driverail being engageable with said shootbolt to drive said shootbolt between a retracted position and an extended position;

an engagement element located in said driverail adjacent said proximal end thereof;

at least one bolt configured for mounting in the groove and pivotally coupled to the driverail, with the bolt configured to extend from and retract into the groove in unison with movement of the shootbolt; and a mortise unit adapted for installation into the lateral edge of the door, said mortise unit having a driving element associated therewith that is moveable between unlocked and locked positions, said driving element engaging said engagement element in said driverail when said mortise unit is installed into the lateral edge of the door after said U-shaped channel and said driverail have been installed into said groove;

wherein said shootbolt and said bolt are driven from said retracted position to said extended position when said driving element of said mortise unit is moved from said unlocked position to said locked position.

16. The multi-point lock of claim 15, wherein the mortise is one of an active mortise and an inactive mortise.

17. The multi-point lock of claim 15, further comprising a cap configured to cover at least the width of the groove, with the cap defining an aperture configured to expose the said bolt.

18. The multi-point lock of claim 17, wherein the cap is configured to engage one of the channel and the groove.

19. The multi-point lock of claim 6, wherein the first shootbolt and first driverail are a single member and wherein the second shootbolt and second driverail are a single member.

* * * * *